US006941887B2

(12) United States Patent
Monlezun

(10) Patent No.: US 6,941,887 B2
(45) Date of Patent: Sep. 13, 2005

(54) BOAT WITH PERIMETER FLOAT, PARTICULARLY A PNEUMATIC LIFE RAFT

(75) Inventor: Alain Monlezun, Donneville (FR)

(73) Assignee: Zodiac International, Issey les Moulineaux (FR)

( * ) Notice: Subject to any disclaimer, the term of this patent is extended or adjusted under 35 U.S.C. 154(b) by 0 days.

(21) Appl. No.: 10/883,946

(22) Filed: Jul. 2, 2004

(65) Prior Publication Data

US 2005/0005837 A1 Jan. 13, 2005

(30) Foreign Application Priority Data

Jul. 7, 2003 (FR) ..... 03 08264

(51) Int. Cl.[7] ..... B63B 7/00
(52) U.S. Cl. ..... 114/345; 441/39
(58) Field of Search ..... 114/34–350, 362; 441/35, 39, 40

(56) References Cited

U.S. PATENT DOCUMENTS 2,914,779 A 12/1959 Walker
2,933,739 A * 4/1960 Miller et al. ..... 441/40
3,155,992 A 11/1964 Shewmake et al.
4,723,929 A 2/1988 Parish

FOREIGN PATENT DOCUMENTS

GB 864586 4/1961
GB 2052398 1/1981

OTHER PUBLICATIONS

Abstract of Japanese Patent Document No. 10297587 (Nov. 10, 1998).

* cited by examiner

*Primary Examiner*—Jesus D. Sotelo
(74) *Attorney, Agent, or Firm*—Dean W. Russell; Kilpatrick Stockton LLP

(57) ABSTRACT

The boat is delimited around its perimeter by a float closed upon itself and comprising at least two superposed floating fender sections. The lower fender section is longer than the upper fender section and extends locally beyond the upper fender section towards the outside. The projecting region delimited by the lower fender section beyond the upper fender section is covered by a covering fixed to the projecting portion of the lower fender section and to that part of the upper fender section bordering this projecting region. Thus, the boat is provided with a projecting zone forming a low platform area onto which a person in the water can raise himself or herself in order to get into the boat more easily.

7 Claims, 1 Drawing Sheet

BOAT WITH PERIMETER FLOAT, PARTICULARLY A PNEUMATIC LIFE RAFT

CROSS-REFERENCE TO RELATED APPLICATION

This application claims priority to French Application No. FR 03 08264 filed on Jul. 7, 2003, the contents of which are incorporated herein by reference.

1. Field of the Invention

The present invention relates to improvements made to boats delimited around their perimeter by a float that is closed upon itself and comprises at least two superposed floating fender sections, and, in particular, to pneumatic life rafts equipped with a perimeter float of double inflatable fender section type.

2. Description of the Prior Art

For a person in the water it is difficult to get into a boat by crossing the latter's edge: because the feet lack support, the person is, in practice, forced to grip onto the edge of the boat with both hands and to raise himself or herself over the edge simply using the strength of his or her arms. This problem may arise irrespective of the type of boat, for example in the case of a person who has fallen overboard. It is also the case with life rafts, with the particular problem that the person in the water may be in a state of panic and/or exhausted, even injured, which renders his or her getting into the boat without external assistance even more problematic.

Admittedly, a variety of accessory equipment for fitting to a boat, particularly a pneumatic life raft, for assisting a person in the water to get into the boat is known. This may, in particular, be lateral ropes or a variety of reliefs on the side of the boat designed to be gripped by the person in the water, flexible ladders (rope ladders, strap-type ladders) fixed to an edge and extending into the water, bars, for example made from wood, attached by flexible connections to one side of the boat, etc. However, because of its lack of rigidity, this equipment is not easy to use, above all in the case of those who lack experience in its use. Furthermore, it is necessary, in this case also, for the person in the water to expend physical effort in order to raise himself or herself on this equipment, which is difficult when this person is exhausted and/or injured.

SUMMARY OF THE INVENTION

An object of the invention is to propose an improved boat that is able to at least partially solve this problem, particularly in the case of pneumatic life rafts.

To this end, the invention proposes a boat delimited around its perimeter by a float that is closed upon itself and comprises at least two superposed floating fender sections, wherein:

- the lower fender section is longer than the upper fender section,
- the lower fender section extends locally beyond the upper fender section towards the outside, and
- the projecting region delimited by the lower fender section beyond the upper fender section is covered by a covering fixed to the projecting portion of the lower fender section and to that part of the upper fender section bordering said projecting region.

A boat in accordance with the invention thus includes a kind of outwardly projecting platform area, which, being located at the level of the lower floating fender section, is, if not at the level of the water, at least very slightly above the water. It thus becomes easier, for a person in the water, to raise himself or herself onto this platform area in a first stage and then, from there, to the inside of the boat in a second stage.

In a preferred embodiment, the fender sections are pneumatically inflatable. It is therefore desirable that, as is the case for the bottom of the boat, said covering should be made from a flexible material.

The arrangement in accordance with the invention defines a kind of recess that may be used for storage and, optionally, be provided with a closure.

The arrangements in accordance with the invention may apply to any type of boat, but a type of boat that is particularly targeted is the pneumatic boat with inflatable fender sections and a flexible bottom.

The arrangement provided in accordance with the invention aims to make it easier for a person in the water to get into the boat. Admittedly, this may be a case of facilitating a bather's boarding the boat in the open sea or in the middle of a river, in a location where that person cannot gain a footing. However, the invention aims primarily to assist persons who have accidentally fallen overboard or in the wake of a shipwreck, who may be in a state of shock and/or exhausted, and even injured. This is why a particularly important application of the arrangements of the invention relates to pneumatic life rafts.

BRIEF DESCRIPTION OF THE DRAWINGS

The invention will be better understood on reading the following detailed description of certain exemplary embodiments that are given solely as a pure illustration. In this description, reference will be made to the single appended drawing, in which.

DETAILED DESCRIPTION OF THE INVENTION

Figure 1:
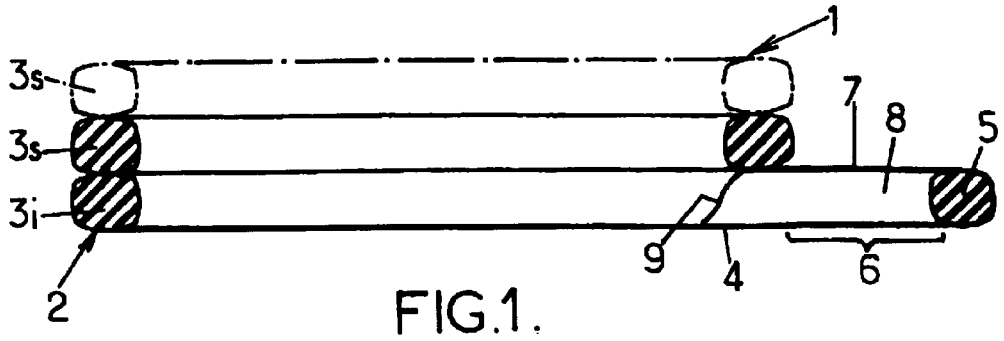
FIG. 1 is a diagrammatic sectional view illustrating the general design of a boat arranged in accordance with the invention.

With reference, firstly, to FIG. 1, a boat 1 is delimited around its perimeter by a float 2 that is closed upon itself and comprises at least two superposed floating fender sections 3. Each fender section 3 may be formed in any appropriate manner in terms of its longitudinal shape (shape of the contour of the boat), the shape of its cross section and its design (pneumatic fender section, or solid fender section made from appropriate material(s)). In FIG. 1, by way of example, each of the two fender sections is illustrated in solid form, with a substantially quadrangular (approximately square) cross section.

The lower fender section **3*i* is provided on the bottom with a bottom 4 of any structure, either rigid (particularly when the fender sections 3 are solid) or flexible (particularly when the fender sections 3** are pneumatic).

In accordance with the invention, the lower fender section **3*i* is longer than the fender section or sections 3*s* surmounting it and the excess length of the lower fender section 3*i* is located at a given point on the periphery of the boat, in other words the lower fender section extends locally, at 5, beyond the upper fender section 3***s*, towards the outside. That is to say that the lower fender section 3*i* delimits a region 6 projecting beyond the upper fender section 3*s* towards the outside.

Lastly, furthermore, this localized projecting region 6, which is bordered by a part of the fender section 3*i*, is covered by a covering 7 fixed onto the projecting portion 5 of the lower fender section 3*i* and to that part of the upper fender section 3*s* that borders said projecting region 6.

By virtue of this arrangement, a kind of low platform area is formed, extending outside the boat proper and located very slightly above the water such that a person in the water, even if that person is exhausted or injured, can relatively easily grip onto this platform area and raise himself or herself onto it and from there gain access to the inside of the boat.

The arrangements in accordance with the invention apply advantageously to boats with pneumatically inflatable fender sections, such boats having a bottom 4 that is flexible. It is therefore appropriate for the covering 7 itself also to be in a flexible form.

As may be clearly seen in FIG. 1, the projecting part 6 delimited on the outside by the portion 5 of the lower fender section 3*i* and covered by the covering 7 defines a kind of recess 8 that is open towards the inside of the boat. This recess 8 may be used to stow equipment. Optionally, a curtain 9 may be provided for closing it by means of lacing or zips.

The arrangements in accordance with the invention apply most particularly advantageously to pneumatic life rafts, which generally consist of two superposed inflatable fender sections and a flexible bottom. The recess 8 closed at the top by the covering 7 made from flexible material may then contain survival equipment, which may be protected more efficiently by virtue of the curtain 9.

The arrangements in accordance with the invention may apply to boats of any configuration and, in particular, to life rafts of any shape and of any size. Two examples of this are given in FIGS. 2 and 3 on the basis of the most common shapes of life raft.

Figure 2:
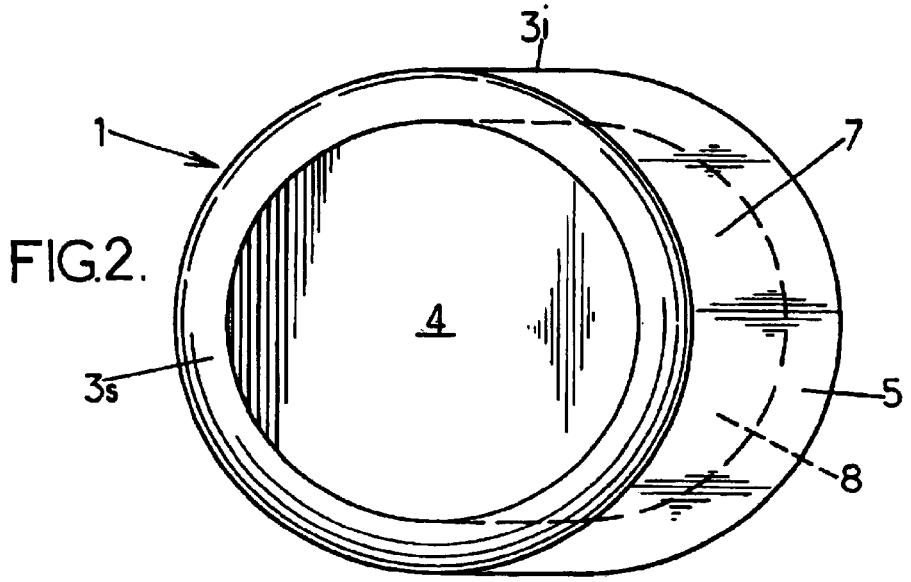
FIG. 2 is a diagrammatic plan view illustrating an example of a pneumatic boat, possibly a life raft, arranged in accordance with the invention.

FIG. 2 illustrates a life raft having a circular-base form. In the arrangement of FIG. 2, the upper fender section 3*i* retains the circular shape and the original dimensions, whilst the lower fender section 3*i* has the approximate shape of an oval, the width of which corresponds to the diameter of the upper fender section 3*s*.

Figure 3:
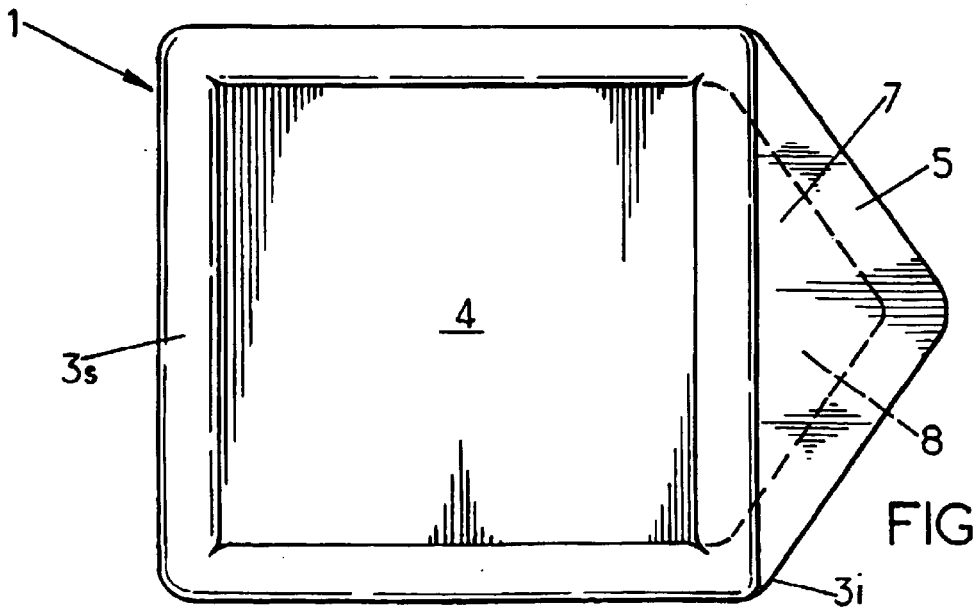
FIG. 3 is a diagrammatic plan view illustrating another example of a pneumatic boat, possibly a pneumatic life raft arranged according to the invention.

FIG. 3 illustrates an arrangement according to the invention that is adapted to a life raft of quadrangular shape, and in this case, more particularly, a square shape. That part 5 of the lower fender section 3*i* that projects beyond the upper fender section 3*s* is folded into a V such that the projecting region 6 is of substantially triangular general shape.

Obviously, the shapes of the projecting regions 6 illustrated in FIGS. 2 and 3 are not dependent upon the respective shapes of the raft base, and the circular raft in FIG. 2 could be provided with a triangular projecting region, as illustrated in FIG. 3, and, conversely, the quadrangular raft in FIG. 3 could be provided with a semi-circular projecting part, as illustrated in FIG. 2.

What is claimed is:

1. A boat having a bottom and being surrounded by a float which extends along a surrounding outline and comprises at least two superposed floating fenders, respectively an upper fender and a lower fender, wherein said upper fender extends alone said outline, wherein said lower fender extends alone the most part of said outline alone which said upper fender is superposed thereto, wherein said lower fender has a developed length which is longer than the developed length of the upper fender so that, in a resting part of said outline, said lower fender extends locally beyond the upper fender towards the outside, wherein said bottom of the boat is fixed to the underside of said lower fender, and wherein a projecting region delimited by the lower fender beyond the upper fender is covered by a covering fixed to the top of said projecting portion of the lower fender and to the part of the upper fender section bordering said projecting region, whereby the boat is provided with a projecting zone providing a low platform area onto which a person in the water can raise himself or herself in order to get into the boat more easily.

2. A boat according to claim 1, wherein the fenders are pneumatically inflatable.

3. A boat according to claim 1, wherein said covering is made from a flexible material.

4. A pneumatic life raft which is made according to claim 1 wherein the fenders are pneumatically inflatable and wherein said covering is made from a flexible material.

5. A life raft comprising a fender set comprising:

a. an upper fender having a peripheral length; and b. a lower fender positioned below the upper fender and having a peripheral length greater than the peripheral length of the upper fender; and in which the upper fender defines a centerline not passing through the lower fender and (ii) the boat is asymmetric about the centerline.

6. A life raft according to claim 5 in which the greater peripheral length of the lower fender creates a projecting region, further comprising means for covering the projecting region so as to create a platform onto which a person in the water can raise himself or herself in order to get into the boat more easily.

7. A life raft according to claim 5 in which at least one of the upper and lower fenders is inflatable.

* * * * *